United States Patent [19]
Medic et al.
[11] 4,236,980
[45] Dec. 2, 1980

[54] PROCESS FOR ALKALI METAL CHLORIDE ELECTROLYSIS

[75] Inventors: Nikolaj Medic, Kelkheim; Theodor Auel, Ilvesheim; Dieter Bergner, Kelkheim; Jürgen Russow, Frankfurt am Main, all of Fed. Rep. of Germany

[73] Assignee: Hoechst Aktiengesellschaft, Frankfurt am Main, Fed. Rep. of Germany

[21] Appl. No.: 86,124

[22] Filed: Oct. 18, 1979

[30] Foreign Application Priority Data

Oct. 21, 1978 [DE] Fed. Rep. of Germany ..... 2845943

[51] Int. Cl.[3] ..... C25B 1/34
[52] U.S. Cl. ..... 204/98; 204/128
[58] Field of Search ..... 204/98, 128

[56] References Cited

U.S. PATENT DOCUMENTS

| | | | |
|---|---|---|---|
| 3,793,163 | 2/1974 | Dotson | 204/98 |
| 3,849,266 | 11/1974 | Corradi et al. | 204/98 |
| 3,988,223 | 10/1976 | Hirozawa | 204/98 |

*Primary Examiner*—R. L. Andrews
*Attorney, Agent, or Firm*—Curtis, Morris & Safford

[57] ABSTRACT

For the electrolysis of an aqueous alkali metal chloride solution in a membrane cell with a perfluorinated cation exchange membrane it is important that there is only a minimum amount of cations of polyvalent metals, such as calcium. Otherwise, deposits within the membrane will occur, among other effects. It has been found that the disturbances caused by the above-mentioned cations can be considerably reduced, if an aliphatic polybasic phosphonic acid or the alkali metal salt thereof is added to the alkali metal chloride solution.

4 Claims, No Drawings

PROCESS FOR ALKALI METAL CHLORIDE ELECTROLYSIS

The present application relates to a process for the electrolysis of industrial alkali metal chloride solutions in cells whose anode and cathode compartments are separated by a permselective cation exchange membrane. Solutions of this type may frequently contain polyvalent cations, such as calcium, magnesium, strontium, iron and optionally mercury.

The membrane employed is hydraulically impermeable and—when using sodium chloride—permits under ideal conditions only sodium ions and water molecules to pass. Purified concentrated brine is introduced into the anode compartment, chlorine and depleted brine are discharged from this compartment. The cathode compartment is charged with water which forms sodium hydroxide solution with the sodium ions passed through the membrane. The lye concentration obtained is determined by the amount of water fed in. The hydrogen and the sodium hydroxide solution formed at the cathode are discharged continuously from the cathode compartment.

The current efficiency in the electrolysis depends essentially on the permselectivity of the membrane separating the anolyte and the catholyte. Said membrane is actually intended to let the cations pass from the anolyte to the catholyte; however, the back-migration of the hydroxide ions from the catholyte, which due to their negative charge are attracted to the anode, is to be largely prevented.

Exchange membranes suitable for the alkali metal chloride electrolysis consist generally of tetrafluoroethylene/perfluorovinyl ether copolymers with acid groups that are laterally bound. These acid groups effect the ion exchange. There have been mainly proposed the groups —$SO_3H$ (U.S. Pat. No. 4,025,405), —$SO_2NHR$ (German Offenlegungsschrift No. 24 47 540, German Auslegeschrift No. 244 154) and —COOH (German Offenlegungsschrift No. 26 30 584).

In order to increase the mechanical strength, the ion exchange film is in most cases reinforced with a backing fabric made of polytetrafluoroethylene. The membranes show a high chemical resistance to chlorine and sodium hydroxide solution. Unfortunately, in the course of prolonged operating periods the properties of these membranes deteriorate. This "ageing" may be attributed at least partially to the presence of alkaline earth or heavy metal ion electrolytes. If these impurities are present, a reduction of the permselectivity and an increase of the electric membrane resistance may already occur after a relatively short operating time, which leads to a rise in energy consumption (expressed in kWh/t of product).

Although there is no final explanation so far as to the reduction of membrane efficiency, it is assumed that in particular the calcium ions present in the brine get into the membrane and deposit there in the form of crystalline calcium hydroxide. Attempts to regenerate the membrane by treating it with acids or extracting it with appropriate complexing agents indeed effect a reduction of electrical resistance, however, the permselectivity of the aged membrane is not improved.

By way of the purification processes common in technology for alkali metal chloride solutions intended for electrolysis (precipitation with alkali metal hydroxide solution and alkali metal carbonate), the calcium content of a brine can be reduced only to about 2 mg of calcium/liter. In order to obtain a better value, an additional purification by means of ion exchangers or by recrystallization of the salt employed in vacuum evaporators is required. However, these methods are too expensive in industry due to their energy consumption and investment costs.

There have been numerous attempts to avoid this additional purification of the brine. According to German Auslegeschrift No. 23 07 466 the formation of difficultly soluble deposits in the membrane is prevented by the formation of a gel at the outer surface of the membrane. This is achieved by adding substances to the brine which form, at a pH of more than 5.5, an insoluble gel with the polyvalent cations. Suitable substances of this kind are alkali metal phosphates and metaphosphates. The insoluble gel has to be removed from the membrane from time to time, which may be achieved by acidification. The process has the drawback, however, that either the membrane must be dismantled (which involves a great expenditure of work and a prolonged standstill of the electrolysis), or the electrolysis must be performed for some time with a strongly acidified brine and a strongly reduced lye concentration with a reduced current density (German Offenlegungsschrift No. 25 48 456).

The treatment with acids is mainly significant for single-layer membranes which carry only sulfonic acid groups as ion exchange radicals.

However, if use is made of the considerably more selective membranes which carry at the cathode side slightly acid sulfonamide or carboxyl groups, the electrolysis with a strongly acidified brine is not very appropriate, since this may involve a degradation of the membrane (blistering and detaching of the slightly acid ion exchange layer during electrolysis).

It has therefore been the object of the invention to find a process which avoids the degradation of the cation exchange membrane caused by impurities of the anolyte without requiring a removal of an insoluble calcium deposit from the membrane.

The addition of complexing metaphosphates to the anolyte solution has already been described. However, under the conditions of the alkali metal chloride electrolysis, metaphosphate is so rapidly decomposed to give orthophosphate that it is indeed used to produce a calcium phosphate gel (German Auslegeschrift No. 23 07 466). The known complexing agent ethylene diamine tetraacetic acid, too, is rapidly destroyed under the above conditions, so that its capability of binding calcium ions is lost.

There has now been found a process for the electrolysis of the aqueous alkali metal chloride solution which is contaminated by cations of polyvalent metals, wherein the anode and cathode compartments of the electrolysis cell are separated from each other by a perfluorinated cation exchange membrane. The process of the invention comprises the feature of adding an aliphatic polybasic phosphonic acid to the alkali metal chloride solution entering the anode compartment. Especially suitable for this purpose are nitrogen-free phosphonic acids. The polybasic phosphonic acid is to contain at least 2 phosphonic acid or carboxylic acid groups in the molecule.

Especially suitable additives are 1-hydroxyalkane-1,1-diphosphonic acids containing from 1 to 5, preferably 1 or 2 carbon atoms in the molecule. These compounds are extremely stable in an acid, neutral or alkaline medium. There may also be used as additives oligo-carboxy-alkanephosphonic acids of the formula I

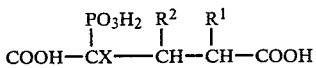

(I), $R^2$ and $R^1$ being hydrogen or $C_1$-$C_4$ alkyl, and X standing for

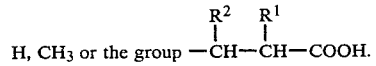

The above-mentioned phosphonic acids are capable of forming soluble stable calcium complexes at pH 11 in an aqueous solution. The term "soluble" means in this case that in the presence of sodium carbonate at pH 11 at least 1 g of calcium ions can be complexed in 1 liter of water without precipitation. For example, 1-hydroxyethane-1,1-diphosphonic acid is capable of complexing about ¼ of its weight of calcium ions.

The addition of these phosphonic acids to a brine which is contaminated by polyvalent cations, such as calcium, magnesium, strontium, barium, iron and possibly mercury, prevents or decelerates the reduction of membrane permselectivity and the increase of membrane resistance. There is no formation of undesirable deposits of phosphate or hydroxides of polyvalent cations at the membrane.

The process of the invention is particularly advantageous when using perfluorinated membranes which contain sulfonamide or carboxyl groups.

The increase of membrane resistance may be further decelerated if the electric power is switched off from time to time for a short period. A substantial reduction of the electrolysis current does not produce this effect.

In this embodiment of the process of the invention it is not necessary either to dilute or to acidify the catholyte and anolyte (cf. German Offenlegungsschrift No. 25 48 456). An optimum is to be seen in 1 to 10, preferably 2 to 5 interruptions of the electrolysis per 24 hours. If the interruptions occur less frequently, membrane resistance (and thus voltage) is rinsing more rapidly, so that the described advantage is getting smaller.

More frequent interruptions show only an insignificant additional effect. It is advantageous to interrupt the process in regular intervals as far as possible, since in this manner—with the same number and duration of interruptions—the effect becomes manifest most clearly. The total duration of the interruptions is in the range of from about 3 to 15 minutes, preferably from 4 to 10 minutes per 24 hours. The advantages involved in the interruption of the current are even seen in the absence of the phosphonic acids, athough in a less distinct manner.

Preference is given to aliphatic phosphonic acids which carry as acid groups only $PO_3H_2$—and possibly also COOH— groups. Furthermore, there may be present hydroxy groups as functional groups.

The amount of phosphonic acid to be added depends on the amount of impurities in the brine (content of $Ca^{++}$ and other bivalent ions) and on the complexing capacity of said acid. The amount of impurities may easily be determined (for example by way of complexometric titration at pH 10 to 12). The complexing capacity of phosphonic acids (towards calcium) has been partially known. As for the rest, it may easily be determined by way of experiment (back-titration of an alkaline phosphonate solution with calcium acetate solution).

TABLE

| Calcium forming capacity of some phosphonic acids | |
|---|---|
| 1-Hydroxyethane-1,1-diphosphonic acid | 240 mg of $Ca^{++}$/g |
| 1,3-dicarboxypropane-1-phosphonic acid | 180 |
| 1,3,5-tricarboxypentane-3-phosphonic acid | 185 |
| 1,2,3-tricarboxypropane-1-phosphonic acid | 210 |

Generally, there is added to the brine from 1 to 5, preferably from 1 to 1.5 times the amount required of phosphonic acid which has been determined by titration. Instead of free phosphonic acid, there may also be used the alkali metal salts thereof. The following examples illustrate the invention.

Test device

The anode and cathode compartments were separated by a perfluorinated cation exchange membrane (surface 36 $cm^2$). Anodes: activated titanium expanded metal. Cathodes: expanded metal of stainless steel.

The brine used for the tests contained per liter besides 310 g of sodium chloride the following impurities: 0.2 mg of magnesium, 6 mg of calcium, 1 mg of strontium, 0.3 mg of barium, 4.8 mg of mercury and 0.2 of iron. The current load of the cells was 11 Amperes, which corresponds to a current density of 30 $A/dm^2$.

EXAMPLE 1: (Example for Comparison)

250 to 260 ml/h of brine were fed continuously into the anode compartment. The pH of the brine had been adjusted to 8.5. Water was fed in doses into the cathode compartment in such an amount that the concentration of the lye produced was 28% of NaOH.

The membrane employed consisted of a (perfluorinated) partially hydrolyzed mixed polymer of $C_2F_4$ and a fluorosulfonyl-perfluorovinyl ether provided with a tetrafluoroethylene backing fabric. At the cathode side, the fluorosulfonyl groups of the membrane had been converted into $—SO_2—NH—C_2H_4—NH—SO_2—$ groups, and at the anode side into sulfonic acid groups (equivalent weight 1150, thickness 180 μm). Trade name: Nafion(R) 214 (manufacturer: Dupont).

In order to determine the current efficiency, the sodium hydroxide solution discharged continuously from the cathode compartment was collected from time to time, and the amount of NaOH was determined. The test results have been shown in the following Table.

TABLE 1

| Operating period in hours | Cell voltage in volts | Current efficiency in % (based on yield of NaOH) | Specific energy consumption in kWh/t of NaOH |
|---|---|---|---|
| 550 | 4.26 | 82 | 3480 |
| 1000 | 4.48 | 77 | 3900 |
| 1500 | 4.60 | 71 | 4240 |

EXAMPLE 2

Example 1 was repeated, however, while adding to the brine 100 mg/liter of 1-hydroxyethane-1,1-diphosphonic acid and adjusting the pH of the brine to a pH of 3.5. In the continuous process, a pH of 4.5 was established in the anolyte. By adding the phosphonic acid, there was a favorable effect on current efficiency and energy consumption. The results may be seen from the following Table.

TABLE 2

| Operating period in hours | Cell voltage in volts | Current efficiency in % (based on yield of NaOH) | Specific energy consumption in kWh/t of NaOH |
|---|---|---|---|
| 500 | 4.0 | 82.5 | 3250 |
| 1000 | 4.17 | 83.8 | 3330 |
| 1500 | 4.4 | 83.4 | 3540 |

EXAMPLE 3

The electrolysis was carried out as has been described in Example 1, but with the difference of adding to the brine 170 mg of 1,3,5-tricarboxypentane-3-phosphonic acid. The results indicate an increase in current efficiency. They have been given in the following Table.

TABLE 3

| Operating period in hours | Cell voltage in volts | Current efficiency in % (based on yield of NaOH) | Specific energy consumption in kWh/t of NaOH |
|---|---|---|---|
| 550 | 4.35 | 85 | 3430 |
| 1000 | 4.4 | 81 | 3640 |

EXAMPLE 4: (Example for Comparison)

The test was carried out as has been described in Example 1, without any addition to the brine; however, amembrane was used which contained carboxyl groups. The membrane was prepared in accordance with German Offenlegungsschrift No. 26 30 548, Example 28, however, while using as starting material a Nafion 415 membrane (polytetrafluoroethylene backing fabric, single-layer membrane with sulfonic acid groups, equivalent weight 1200). The thickness of the membrane employed in Example 4 was 120 μm. The drop in current efficiency and the rise of cell voltage depending on the operating period becomes evident from the following Table.

TABLE 4

| Operating period in hours | Cell voltage in volts | Current efficiency in % (based on yield of NaOH) | Specific energy consumption in kWh/t of NaOH |
|---|---|---|---|
| 500 | 4.41 | 87 | 3400 |
| 1000 | 4.43 | 81 | 3670 |

TABLE 4-continued

| Operating period in hours | Cell voltage in volts | Current efficiency in % (based on yield of NaOH) | Specific energy consumption in kWh/t of NaOH |
|---|---|---|---|
| 2000 | 4.48 | 75 | 4000 |

EXAMPLE 5

Example 4 was repeated, however, while adding to the brine 100 mg/l of hydroxyethane-diphosphonic acid. The values of current efficiency and the energy consumption may be seen from the following Table.

TABLE 5

| Operating period in hours | Cell voltage in volts | Current efficiency in % (based on yield of NaOH) | Specific energy consumption in kWh/t of NaOH |
|---|---|---|---|
| 500 | 4.2 | 83 | 3400 |
| 1000 | 4.13 | 83 | 3340 |
| 2000 | 4.45 | 81 | 3680 |

EXAMPLE 6

Example 2 is repeated. After an operating period of 2000 hours the cell voltage is 4.47 volts. When interrupting the further progress of the electrolysis every 12 hours for 3 to 5 minutes each, the cell voltage is at first reduced to 4.1 to 4.25 volts and then remains at this level for the following 500 hours.

If on the other hand the process is carried out without the addition of phosphonic acid, the cell voltage is about 4.7 volts after an operating period of 2600 hours. When interrupting the further progress of the electrolysis every 12 hours for 3 to 5 minutes each, the cell voltage is at first reduced to 4.6 volts. In the course of the following 500 hours of operation, it rises slowly to 4.75 volts.

What is claimed is:

1. Process for the electrolysis of an aqueous alkali metal chloride solution which is contaminated by cations of polyvalent metals, in an electrolysis cell whose anode and cathode compartments are separated by a perfluorinated cation exchange membrane, which comprises adding to the alkali metal chloride solution an aliphatic polybasic phosphonic acid or the alkali metal salt thereof.

2. A process as claimed in claim 1, wherein the phosphonic acid is free of nitrogen.

3. A process as claimed in claim 1, wherein the phosphonic acid contains at least 2 $PO_3H_2$ or COOH groups in the molecule.

4. A process as claimed in claim 1, which comprises interrupting the electrolysis current for a short time once to 10 times per 24 hours.

* * * * *